US008419464B2

(12) United States Patent
Montena et al.

(10) Patent No.: US 8,419,464 B2
(45) **Date of Patent: *Apr. 16, 2013**

(54) COAXIAL CONNECTOR WITH INTEGRATED MOLDED SUBSTRATE AND METHOD OF USE THEREOF

(75) Inventors: Noah Montena, Syracuse, NY (US); Robert Bowman, Fairport, NY (US); Ryan Vaughan, Nassau, NY (US)

(73) Assignees: PPC Broadband, Inc., East Syracuse, NY (US); Rochester Institute of Technology, Rochester, NY (US)

( * ) Notice: Subject to any disclaimer, the term of this patent is extended or adjusted under 35 U.S.C. 154(b) by 140 days.

This patent is subject to a terminal disclaimer.

(21) Appl. No.: 12/966,113

(22) Filed: Dec. 13, 2010

(65) Prior Publication Data

US 2011/0130034 A1 Jun. 2, 2011

Related U.S. Application Data

(63) Continuation-in-part of application No. 12/271,999, filed on Nov. 17, 2008, now Pat. No. 7,850,482.

(51) Int. Cl.
*H01R 9/05* (2006.01)

(52) U.S. Cl.
USPC ..... 439/489; 439/913; 439/620.03

(58) Field of Classification Search ..... 439/578, 439/489, 620.03, 913; 340/635
See application file for complete search history.

(56) References Cited

U.S. PATENT DOCUMENTS

| | | | | |
|---|---|---|---|---|
| 2,640,118 | A * | 5/1953 | Werner | 333/22 R |
| 3,196,424 | A | 7/1965 | Hardesty et al. | |
| 3,388,590 | A | 6/1968 | Bond | |
| 3,396,339 | A | 8/1968 | Miram | |
| 3,524,133 | A | 8/1970 | Arndt | |
| 3,657,650 | A | 4/1972 | Arndt | |
| 3,686,623 | A | 8/1972 | Nijman | |
| 3,768,089 | A | 10/1973 | Costanzo | |
| 3,808,580 | A | 4/1974 | Johnson | |
| 3,945,704 | A | 3/1976 | Kraus et al. | |
| 3,960,428 | A | 6/1976 | Naus et al. | |
| 3,961,330 | A | 6/1976 | Davis | |
| 4,034,289 | A | 7/1977 | Rozylowicz et al. | |
| 4,084,875 | A | 4/1978 | Yamamoto | |

(Continued)

FOREIGN PATENT DOCUMENTS

EP 0527599 A1 2/1993

OTHER PUBLICATIONS

U.S. Appl. No. 12/271,999, filed Nov. 17, 2008. Customer No. 5417.

(Continued)

*Primary Examiner* — Neil Abrams
(74) *Attorney, Agent, or Firm* — Schmeiser, Olsen & Watts, LLP

(57) ABSTRACT

A substrate structure is provided, the substrate structure comprising: a molded substrate located within a connector body of a coaxial cable connector and an electrical structure mechanically connected to the molded substrate. The electrical structure is located in a position that is external to a signal path of a radio frequency (RF) signal flowing through the coaxial cable connector. The electrical structure may form a sensing circuit configured to sense physical parameters such as a condition of the RF electrical signal flowing through the connector or a presence of moisture in the connector.

22 Claims, 10 Drawing Sheets

U.S. PATENT DOCUMENTS 4,240,445 A 12/1980 Iskander et al.
4,421,377 A 12/1983 Spinner
4,489,419 A 12/1984 Wang
4,758,459 A * 7/1988 Mehta ..... 428/131
4,777,381 A 10/1988 Fernandes
4,898,759 A * 2/1990 Hoover et al. ..... 428/99
4,911,655 A 3/1990 Pinyan et al.
4,915,639 A 4/1990 Cohn et al.
4,927,382 A 5/1990 Huber
5,059,948 A 10/1991 Desmeules
5,076,797 A * 12/1991 Moulton ..... 439/188
5,169,329 A 12/1992 Taguchi
5,194,016 A 3/1993 Hatagishi et al.
5,217,391 A 6/1993 Fisher, Jr.
5,225,816 A 7/1993 Lebby et al.
5,278,525 A 1/1994 Palinkas
5,278,571 A 1/1994 Helfrick
5,345,520 A 9/1994 Grile
5,355,883 A 10/1994 Ascher
5,462,450 A 10/1995 Kodama
5,490,033 A 2/1996 Cronin
5,491,315 A * 2/1996 McMills et al. ..... 200/504
5,518,420 A 5/1996 Pitschi
5,561,900 A 10/1996 Hosler, Sr.
5,565,783 A 10/1996 Lau et al.
5,565,784 A 10/1996 DeRenne
5,620,330 A 4/1997 Pizon
5,664,962 A 9/1997 Noda
5,892,430 A 4/1999 Wiesman et al.
5,904,578 A 5/1999 Kubota et al.
5,924,889 A 7/1999 Wang
6,034,521 A 3/2000 Eckardt
6,041,644 A 3/2000 Harde
6,093,043 A 7/2000 Gray et al.
6,134,774 A 10/2000 Williams et al.
6,193,568 B1 2/2001 Dorr
6,236,551 B1 5/2001 Jones et al.
6,243,654 B1 6/2001 Johnson et al.
6,362,709 B1 3/2002 Paxman et al.
6,414,636 B1 7/2002 Godard et al.
6,490,168 B1 12/2002 Rochowicz et al.
6,549,017 B2 4/2003 Coffeen
6,570,373 B1 5/2003 Viola
6,618,515 B2 9/2003 Kimura et al.
6,646,447 B2 11/2003 Cern et al.
6,650,885 B2 11/2003 Anderson et al.
6,755,681 B2 6/2004 Chen
6,783,389 B1 8/2004 Lee
6,859,029 B2 2/2005 Yamanaka et al.
6,896,541 B2 5/2005 Benson
6,986,665 B2 1/2006 Schauz et al.
7,029,327 B2 4/2006 Devine
7,084,769 B2 8/2006 Bauer et al.
7,094,104 B1 * 8/2006 Burke et al. ..... 439/620.01
7,105,982 B1 9/2006 Hagood, IV et al.
7,173,343 B2 2/2007 Kugel
7,212,125 B2 5/2007 Shanks et
7,253,602 B2 8/2007 Shvach et al.
7,254,511 B2 8/2007 Niedzwiecki et al.
7,262,626 B2 8/2007 Iwasaki
7,264,493 B2 * 9/2007 Cooper et al. ..... 439/188
7,266,269 B2 9/2007 Koste et al.
7,268,517 B2 9/2007 Rahmel et al.
7,276,267 B2 10/2007 Schauz
7,276,703 B2 10/2007 Berkcan et al.
7,368,827 B2 5/2008 Kulkarni et al.
7,413,353 B2 8/2008 Beer et al.
7,440,253 B2 10/2008 Kauffman
7,472,587 B1 1/2009 Loehndorf et al.
7,479,886 B2 1/2009 Burr
7,482,945 B2 1/2009 Hall
7,507,117 B2 3/2009 Amidon
7,513,795 B1 4/2009 Shaw
7,544,086 B1 6/2009 Wells
7,642,611 B2 1/2010 Tsuji et al.
7,733,236 B2 6/2010 Montena et al.
7,749,022 B2 7/2010 Amidon et al.
7,775,115 B2 8/2010 Theuss et al.
7,850,482 B2 12/2010 Montena et al.
7,909,637 B2 3/2011 Montena
7,930,118 B2 4/2011 Vinden et al.
8,092,234 B2 1/2012 Friedhof et al.
8,149,127 B2 4/2012 Montena
2002/0090958 A1 7/2002 Ovard et al.
2003/0096629 A1 5/2003 Elliott et al.
2003/0148660 A1 8/2003 Devine
2004/0232919 A1 11/2004 Lacey
2006/0019540 A1 1/2006 Werthman et al.
2007/0173367 A1 7/2007 Duncan
2008/0258876 A1 10/2008 Overhultz et al.
2009/0022067 A1 1/2009 Gotwals
2009/0096466 A1 4/2009 Delforce et al.
2009/0115427 A1 5/2009 Radtke et al.
2009/0284354 A1 11/2009 Pinkham
2010/0081324 A1 4/2010 Montena
2010/0124838 A1 5/2010 Montena et al.
2010/0124839 A1 5/2010 Montena
2011/0074388 A1 * 3/2011 Bowman ..... 324/76.38
2011/0077884 A1 3/2011 Bowman
2011/0080057 A1 4/2011 Bowman et al.

OTHER PUBLICATIONS

U.S. Appl. No. 12/960,592, filed Dec. 6, 2010; Confirmation No. 7529.
U.S. Appl. No. 12/961,555, filed Dec. 7, 2010; Confirmation No. 9390.
U.S. Appl. No. 12/965,961, filed Dec. 13, 2010; Confirmation No. 7882.
International Search Report and Written Opinion. PCT/US2010/052861. Date of Mailing: Jun. 24, 2011. 9 pages.
Office Action (Mail date Jul. 12, 2012) for U.S. Appl. No. 12/961,555, filed Dec. 7, 2010.
Notice of Allowance (Mail date Jul. 11, 2012) for U.S. Appl. No. 12/960,592, filed Dec. 6, 2010.
Office Action (Mail date Jun. 28, 2012) for U.S. Appl. No. 12/965,961, filed Dec. 13, 2010.

* cited by examiner

COAXIAL CONNECTOR WITH INTEGRATED MOLDED SUBSTRATE AND METHOD OF USE THEREOF

CROSS-REFERENCE TO RELATED APPLICATIONS

This application is a continuation-in-part of and claims priority from co-pending U.S. application Ser. No. 12/271,999 filed Nov. 17, 2008, and entitled COAXIAL CONNECTOR WITH INTEGRATED MATING FORCE SENSOR AND METHOD OF USE THEREOF.

BACKGROUND

1. Technical Field

The present invention relates generally to coaxial connectors. More particularly, the present invention relates to a coaxial connector having an integrated interconnect device and related method of use.

2. Related Art

Cable communications have become an increasingly prevalent form of electromagnetic information exchange and coaxial cables are common conduits for transmission of electromagnetic communications. In addition, various coaxial cable connectors are provided to facilitate connection of cables to various devices. It is important that a coaxial cable connector be properly connected or mated to an interface port of a device for cable communications to be exchanged accurately. One way to help verify whether a proper connection of a coaxial cable connector is made is to determine and report mating force in the connection. However, common coaxial cable connectors have not been provided, whereby mating force can be efficiently determined by the coaxial cable connectors. Ordinary attempts at determining mating force have generally been inefficient, costly, and impractical involving multiple devices and complex applications. Accordingly, there is a need for an improved connector for determining mating force. The present invention addresses the abovementioned deficiencies and provides numerous other advantages.

SUMMARY

The present invention provides an apparatus for use with coaxial cable connections that offers improved reliability.

A first aspect of the present invention provides A coaxial cable connector for connecting a coaxial cable to a mating component, the mating component having a conductive interface sleeve, the coaxial cable connector comprising: a connector body having an internal passageway defined therein; a first insulator component disposed within the internal passageway of the connector body; a capacitive circuit positioned on a face of the first insulator component, the first insulator component at least partially defining a first plate of a capacitor; and a flexible member in immediate proximity with the face of the first insulator component, the flexible member at least partially defining a capacitive space between the face of the first insulator and the flexible member, wherein the flexible member is movable upon the application of mating forces created as the conductive interface sleeve interacts with the flexible member.

A second aspect of the present invention provides a coaxial cable connector comprising: a connector body; a capacitive circuit positioned on a face of a first insulator component, the first insulator component located within the connector body; a flexible member located proximate the face of the first insulator component, the flexible member being movable due to mating forces when the connector is connected to a mating component; and a capacitive space located between the face of the first insulator component and the flexible member; wherein the flexible member forms at least one boundary surface of the capacitive space, and the face of the first insulator forms at least another boundary surface of the capacitive space.

A third aspect of the present invention provides a mating force sensing coaxial cable connector comprising: a sensing circuit printed on the face of a first spacer component positioned to rigidly suspend a center conductor contact within an outer conducting housing; and a capacitive space in immediate proximity with the sensing circuit, said capacitive space having at least one defining wall configured to undergo elastic deformation as a result of mating forces.

A fourth aspect of the present invention provides a coaxial cable connector comprising: a connector body; an insulator component and an interface sleeve housed by a connector body; a capacitive space formed between the insulator component and the interface sleeve; and means for sensing proper mating by determining a change in size of the capacitive space due to mating forces.

A fifth aspect of the present invention provides a method for detecting mating force of a mated coaxial cable connector, said method comprising: providing a coaxial cable connector including: a sensing circuit positioned on a face of a spacer component located within a connector body; a capacitive space in immediate proximity with the sensing circuit; and an interface component having a flexible member forming at least one boundary surface of the capacitive, said flexible member being movable due to mating forces; mating the connector with a connecting device; bending the flexible member of the interface component due to contact with the connecting device during mating, thereby reducing the size of capacitive space; and detecting mating force by sensing the reduction of size of the capacitive space by the sensing circuit.

A sixth aspect of the present invention provides a connector body having a first end and a second end, the first end having a first bore; a first insulator located within the first bore, the first insulator having a first face; a mount portion defined on the first face; a capacitive circuit positioned on the mount portion; and, an interface member, having a first section and a second section, the interface member located within the first bore in immediate proximity to the mount portion to define a capacitive space, the first section having a first section bore, the first and second sections being movable between a first position and a second position upon the application of an axial force on the first section.

A seventh aspect of the present invention provides a substrate structure comprising: a molded substrate located within a connector body of a coaxial cable connector; and an electrical structure mechanically connected to the molded substrate, wherein the electrical structure is located in a position that is external to a signal path of a radio frequency (RF) signal flowing through the coaxial cable connector.

An eighth aspect of the present invention provides a coaxial cable connector for connection to a coaxial cable, the connector comprising: a connector body; and a molded substrate structure located within the connector body, wherein the molded substrate structure comprises an electrical structure mechanically connected to the molded substrate structure, wherein the electrical structure is located in a position that is external to a signal path of a radio frequency (RF) signal flowing through the coaxial cable connector.

A ninth aspect of the present invention provides a method comprising:

providing substrate structure comprising a molded substrate located within a connector body of a coaxial cable connector and an electrical structure mechanically connected to the molded substrate, wherein the electrical structure is located in a position that is external to a signal path of a radio frequency (RF) signal flowing through the coaxial cable connector; and sensing, by the electrical structure, the RF signal flowing through the coaxial cable connector.

The foregoing and other features of the invention will be apparent from the following more particular description of various embodiments of the invention.

DESCRIPTION OF THE DRAWINGS

Some of the embodiments of this invention will be described in detail, with reference to the following figures, wherein like designations denote like members, wherein.

DETAILED DESCRIPTION

Figure 1:
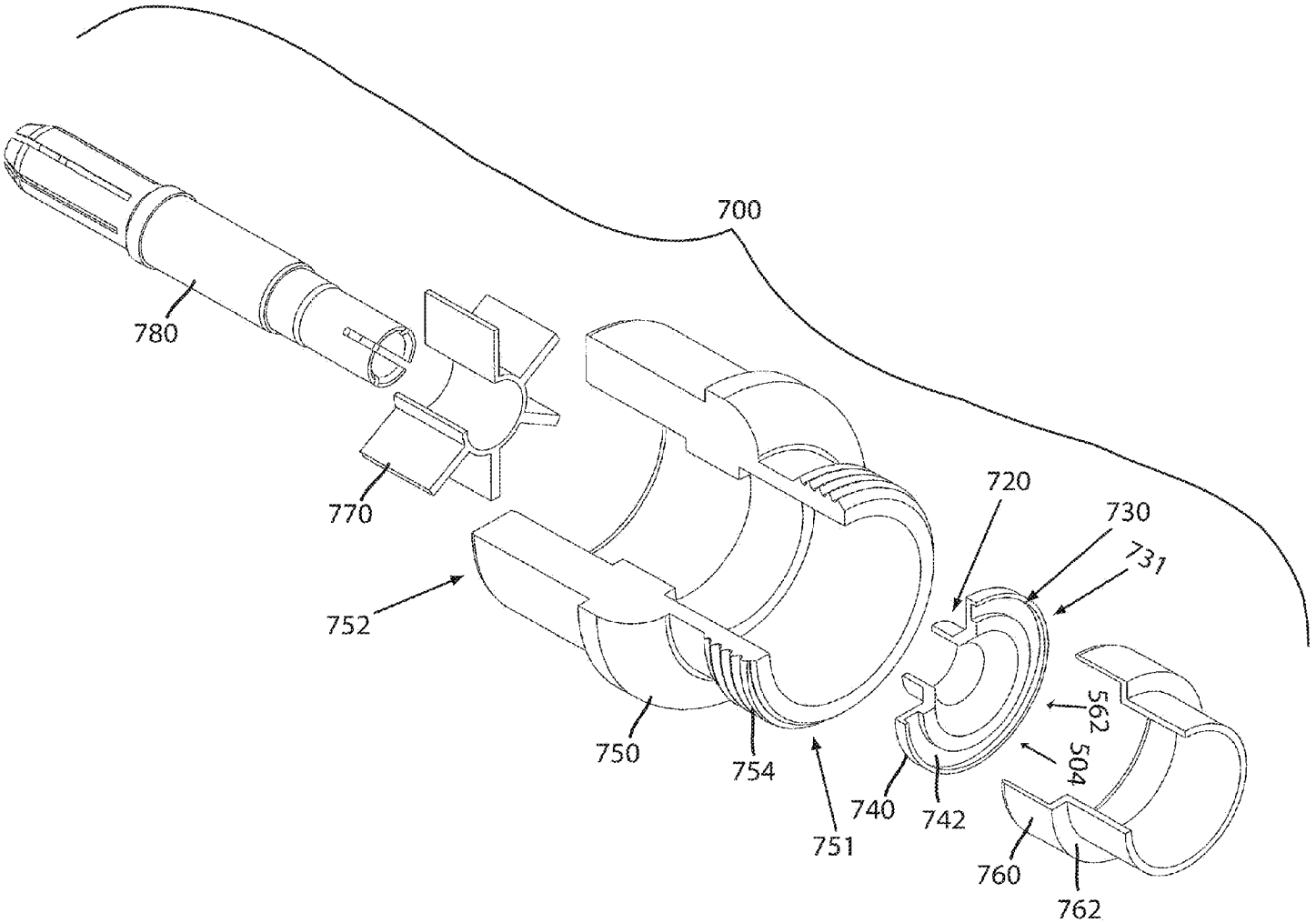
FIG. 1 depicts an exploded cut-away perspective view of an embodiment of a coaxial cable connector with a molded substrate, in accordance with the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a", "an" and "the" include plural referents, unless the context clearly dictates otherwise.

Referring to the drawings, FIG. 1 depicts an exploded cut-away perspective view of an embodiment of a coaxial cable connector 700, in accordance with the present invention. The coaxial cable connector 700 may include electrical devices and circuitry including, among other things, a sensing circuit 730 (e.g., an integrated mating force sensing circuit), a coupler 720, an integrated circuit 504 (illustrated in FIGS. 8C and 8D), electrical components 562 (e.g., electrical components), conductive interconnects or traces 731, etc. A sensing circuit 730 may include, among other things, an integrated mating force sensing circuit, a transducer/sensor (e.g., sensors for generating data regarding a performance, moisture content, temperature, tightness, efficiency, and alarm conditions, etc for the coaxial cable connector 700), etc. A coupler 720 (e.g., an antenna) is configured to: sense a condition or electrical parameter of a signal flowing through a connector at a given time or over a given time period, harvest power from a signal (e.g., an RF signal) flowing through a coaxial connector. An electrical parameter may comprise, among other things, an electrical signal (RF) power level, wherein the electrical signal power level may be used for discovering, troubleshooting and eliminating interference issues in a transmission line (e.g., a transmission line used in a cellular telephone system). The coaxial cable connector 700 may include internal circuitry that may sense connection conditions, harvest power, store data, and/or determine monitorable variables of physical parameter status such as presence of moisture (humidity detection, as by mechanical, electrical, or chemical means), connection tightness (applied mating force existent between mated components), temperature, pressure, amperage, voltage, signal level, signal frequency, impedance, return path activity, connection location (as to where along a particular signal path a connector 100 is connected), service type, installation date, previous service call date, serial number, etc. Additionally, an insertion of an electrically small low coupling magnetic antenna (e.g., coupler 720) may used to harvest power from RF signals and measure an integrity of passing RF signals (i.e., using the electromagnetic fields' fundamental RF behavior). The coupler 720 may be designed at a very low coupling efficiency in order to avoid insertion loss. Harvested power may be used to power an on board data acquisition structure (e.g., integrated circuit 504, circuitry 562, etc). Sensed RF signal power may be fed to an on board data acquisition structure (e.g., integrated circuit 504). Data gathered by the integrated circuit 504 is reported back to a data gathering device (e.g., a transmitter, a receiver, a combiner, etc) through a transmission path (i.e., a coaxial cable) or wirelessly.

The connector 700 includes a connector body 750. The connector body 750 comprises an outer housing surrounding an internal passageway 755 (shown in FIG. 2) accommodating internal components assembled within the connector 700. In addition, the connector body 750 may be conductive. The connector 700 comprises a molded substrate 740 being a first insulator component (e.g., as described in detail with respect to FIGS. 8A-8F). A first end 751 of the connector body 750 includes a threaded surface 754. The first end 751 also includes an axial opening large enough to accommodate the molded substrate 740 and an interface sleeve 760. Moreover, an opposing second end 752 of the connector body 750 includes an axial opening large enough to accommodate a spacer 770. The spacer 770 is a second insulator component and is located to operate with an internal surface of the connector body 750 to stabilize a center conductor contact 780 and help retain substantially axial alignment of the center conductor contact 780 with respect to the connector body 750 when the connector 700 is assembled.

The molded substrate 740 is formed of a dielectric material and may be housed within the connector body 750 and positioned to contact and axially align the center conductor 780. The molded substrate 740 is positioned to rigidly suspend the inner conductor contact 780 within the outer conducting housing or connector body 750. The molded substrate 740 is an insulator component positioned to help facilitate an operable communication connection of the connector 700. In addition, the molded substrate 740 may include a face 742 (on or within) which a sensing circuit 730, coupler 720, conductive interconnects or traces 731, electrical components 562, and/or an integrated circuit 504 (e.g., a semiconductor device such as, among other things, a semiconductor chip) that may include any type of data acquisition/transmission/memory circuitry (e.g., an impedance matching circuit, an RF power sensing circuit, a RF power harvesting/power management circuit, etc) may be positioned. The face 742 may be the bottom of an annular ring-like channel formed into the molded substrate 740 and the sensing circuit 730, coupler 720, conductive interconnects or traces 731, electrical components 562, and/or an integrated circuit 504 may be printed onto and/or within the face 742. For example, a capacitive circuit may be printed on the face 742 of the molded substrate 740, wherein the capacitive circuit is a sensing circuit 730. Printing the sensing circuit 730 or the aforementioned components onto a face 742 of the molded substrate 740 affords efficient connector 700 fabrication because the sensing circuit 730 can be provided on components, such as the molded substrate 740. Moreover, assembly of the connector 700 is made efficient because the various connector components, such as the molded substrate 740, center conductor 780, interface sleeve 760, connector body 750 and spacer 770 are assembled in a manner consistent with typical connector assembly. Printing, a sensing circuit 730, on a typical component can also be more efficient than other means because assembly of small non-printed electronic sensors to the interior surfaces of typical connector housings, possibly wiring those sensors to a circuit board within the housing and calibrating the sensors along with any mechanical elements can be difficult and costly steps. A printed sensing circuit 730 integrated on a typical connector 700 assembly component reduces assembly complexity and cost. Accordingly, it may be desirable to "print" sensing circuits 730 and other associated circuitry in an integrated fashion directly onto structures, such as the face 742 of the molded substrate 740 or other structures already present in a typical connector 700. Furthermore, printing the sensing circuits 730 onto connector 700 components allows for mass fabrication, such as batch processing of the first spacers 40 being insulator components having sensing circuits 730 printed thereon. Printing the sensing circuit 730 may involve providing conductive pathways, or traces, etched from copper sheets or other conductive materials, laminated or otherwise positioned onto a non-conductive substrate, such as the first spacer insulator component 740.

An interface sleeve 760 of a connector 700 may include a flexible member 762. The flexible member 762 is a compliant element of the sleeve 760. Because the flexible member 762 is compliant, it can bend in response to contact with mechanical elements in the interface of another component, such as a male connector 500 (see FIGS. 4-6). Thus, the flexible member 762 may directly experience mating forces when connected to another component, such as a male connector 500, and undergo movement as a result, as will be discussed further herein below.

Figure 2:
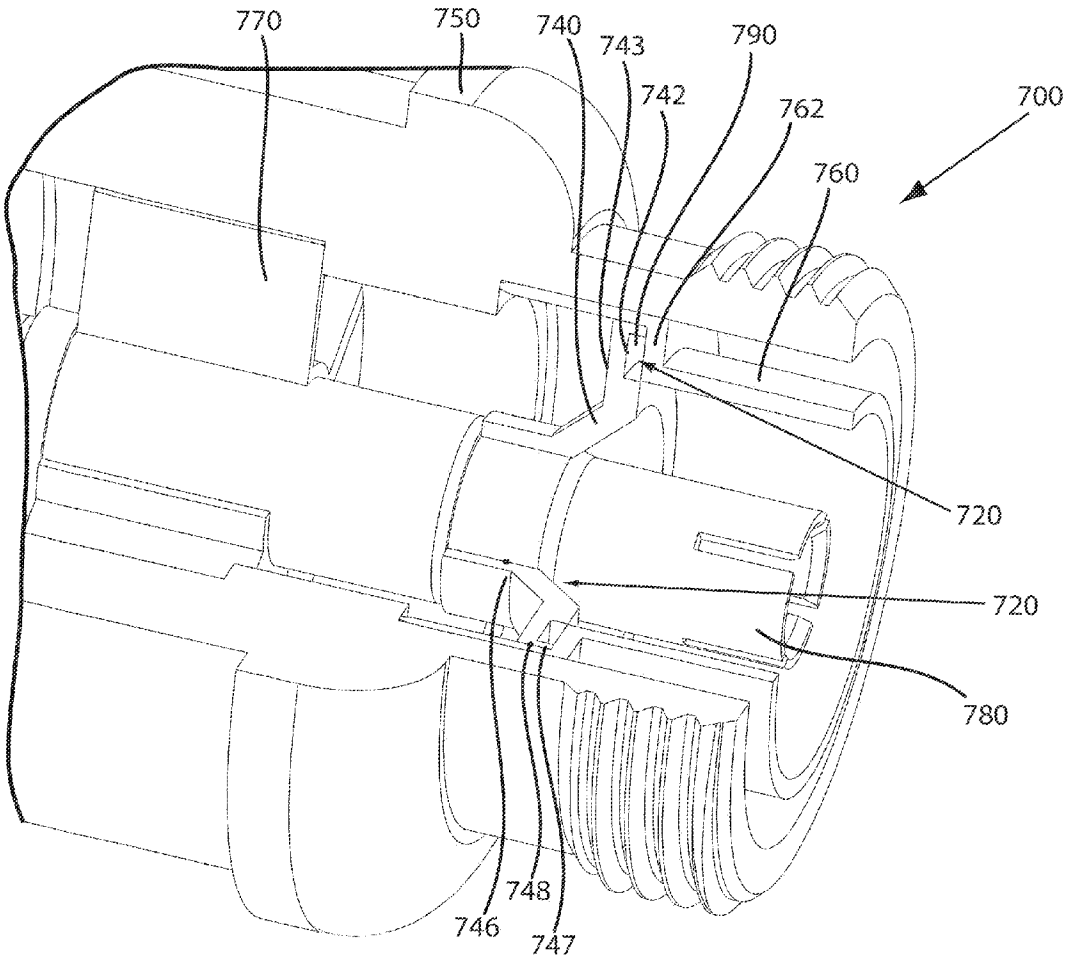
FIG. 2 depicts a close-up cut-away perspective view of a first end of an embodiment of a coaxial cable connector with a molded substrate, in accordance with the present invention.

Referring further to the drawings, FIG. 2 depicts a close-up cut-away perspective view of a first end 751 of an embodiment of a coaxial cable connector 700 with (integrated mating force) sensing circuit 730, in accordance with the present invention. The sensing circuit 730, coupler 720, conductive interconnects or traces 731, electrical components 562, and/or an integrated circuit 504 may be printed on a face 742 of a molded substrate 740 in proximity with a capacitive space 790, such as a resonant cavity or chamber in the interface between the molded substrate 740 and the interface sleeve 760. The sensing circuit 730 may be a capacitive circuit. The capacitive space 790 cavity, such as a cavity or chamber may includes at least one wall or boundary surface movable due to mating forces. For example, a surface of the flexible member 762 of the interface sleeve 760 may comprise a boundary surface of the capacitive space 790. The flexible member 762 is a compliant portion of the interface sleeve 760 operable to endure motion due to movement from mating forces. Moreover, the flexible member 762 may be resilient and configured such that motions due to mating forces bend the member 762 within its elastic range so that the member 762 can return to its previous non-motivated position once the mating forces are removed. Additionally, the member 762 may also be configured to have some elastic hysteresis in that member 762 may be physically responsive relative to varying motive force and include inherent tendency to return to a previous dynamic physical condition. The flexible member 762 may be formed such that movement due to motive force is resistive to yielding and/or may also be cable of elastic response only within a specific range of movement. Nevertheless, some embodiments of the flexible member 762 may be designed to yield if moved too far by mating forces. The interface sleeve 760 may be formed of metals or metal allows such as brass, copper, titanium, or steel, plastics (wherein the plastics may be formed to be conductive), composite materials, or a combination thereof.

When the connector 700 is assembled, the flexible member 762 is in immediate proximity with the capacitive space 790. Movements of the flexible member 762 cause changes in the size associated with the capacitive space 790. The capacitive space 790 size may therefore by dynamic. Changes in the size of the capacitive space 790 may produce changes in the capacitance of the printed sensing circuit 730 and are therefore ascertainable as a physical parameter status. The face 742 of the insulator may be or include a fixed electrode, such as a fixed plate 744, and the flexible member 762 may be or include a movable electrode. The distance between the electrodes, or the size of the capacitive space between the electrodes, may vary inversely with the applied torque. The closer flexible member 762 gets to the fixed plate 744, the larger the effective capacitance becomes. The sensing circuit 730 translates the changes in capacitance to connector tightness and determines if the connector 700 is too loose. The capacitive space 790 may be a resonant chamber or capacitive cavity. The dimensional space of the capacitive space 790 can be easily manufactured to very tight tolerances either by forming at least a portion of the space 790 directly into the molded substrate 740, forming it into portion of the housing 750, forming it into a portion of the interface sleeve 760, or a combination of the above. For example, an annular channel may be formed in molded substrate 740, wherein a capacitive sensing circuit 730 is positioned on the bottom face 742 of the channel to form an annular diaphragm capacitor responsive to resonant variation due to changes in the size of cavity 790. The capacitive space 790 may be filled with air, wherein the air may function as a dielectric. However, the capacitive space 790 may be filled with some other material such as dielectric grease. Moreover, portions of the cavity capacitive space 790 boundaries, such as surfaces of the spacer 740 or flexible member 760 may be coated with dielectric material. Because the connector 700 assembly creates a sandwich of parts, the capacitive space or resonant cavity 790 and sensing circuit 730 need not be adjusted or calibrated individually for each connector assembly, making assembly of the connector 700 no different from a similar common coaxial cable connector that has no sensing circuit 730 built in.

Power for the sensing circuit 730, electrical components 562, and/or an integrated circuit 504 may be provided through indirect (i.e., via coupler 720) or direct (via traces) electrical contact with the center conductor 780. As a first example, an indirect coupling device (such as a directional coupler) may be used to retrieve or sample (i.e., indirectly) RF energy propagating along a center coaxial line. As a second example, traces may be printed on the molded substrate 740 and positioned so that the traces make electrical contact with the center conductor contact 780 at a location 746. Electrical contact with the center conduct contact 780 (via coupler 720 or conductive traces) at location 46 facilitates the ability for the sensing circuit 730, electrical components 562, and/or an integrated circuit 504 to draw power from the cable signal(s) passing through the center conductor contact 780. Traces may also be formed and positioned so as to make contact with grounding components. For example, a ground path may extend through a location 748 between the molded substrate 740 and the interface sleeve 760. Alternatively, a ground isolation circuit may be provided to generate a negative voltage to be used as a reference signal (i.e., a ground).

The sensing circuit 730 can communicate sensed mating forces. The sensing circuit 730, such as a capacitive circuit, may be in electrical communication with an output component such as traces or a coupler 720 electrically connected to the center conductor contact 780. For example, sensed conditions due to mating forces, such as changes in capacitance of the cavity or chamber 790, may be passed as an output signal from the sensing circuit 730 of the molded substrate 740 through an output component, such as a coupler 720 or traces, electrically linked to the center conductor contact 780. The outputted signal(s) can then travel along the cable line corresponding to the cable connection applicable to the connector 700. Hence, the signal(s) from the sensing circuit 730 may be accessed at a point along the cable line. In addition, traces or conductive elements of an output component in communication with a sensing circuit 730 may be in electrical contact with output leads available to facilitate connection of the connector 700 with electronic circuitry that can manipulate the sensing circuit 730 operation.

A portion of the molded substrate 740, such as a flange 747, may be compressible or bendable. As the flexible member 762 of the interface sleeve 760 moves due to mating forces, the flange 747 may compress or bend as it interacts with the flexible member 762. The compressible or bendable nature of a portion of the molded substrate 740, such as flange 747, may permit more efficient movement of the flexible member 762. For instance, the flange 747 may contribute resistance to movement of the flexible member 762, but still allow some bending of the member. In addition, the molded substrate 740 may bend with respect to a rear wall or surface 743 as the flexible member 762 bends due to mating forces and interacts with the molded substrate 740.

Figure 3:
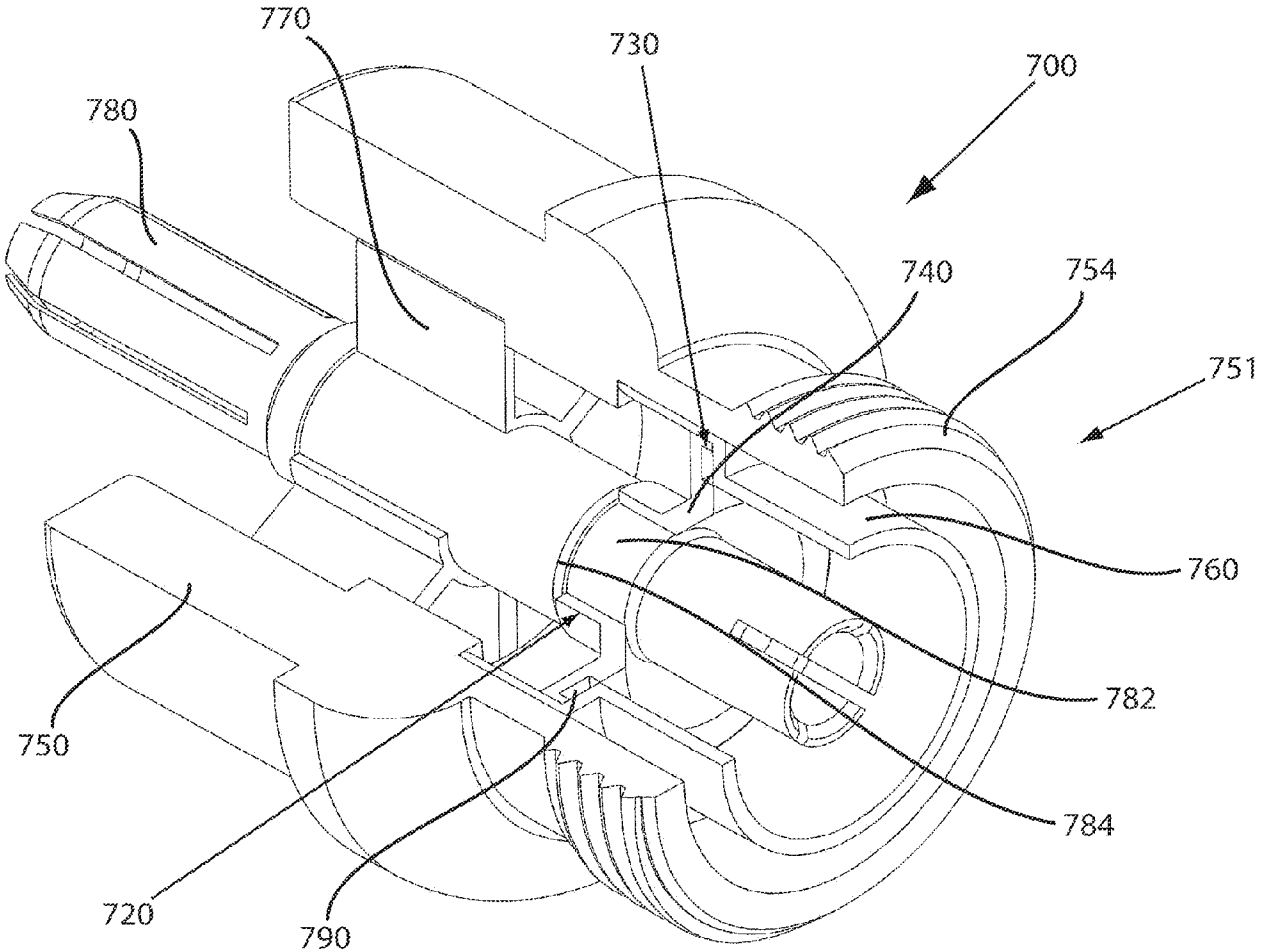
FIG. 3 depicts a cut-away perspective view of an embodiment of an assembled coaxial cable connector with a molded substrate, in accordance with the present invention.

FIG. 3 depicts an embodiment of an assembled coaxial cable connector 700 with integrated mating force sensing circuit 730. The threaded surface 754 of the first end of connector body 750 facilitates threadable mating with another coaxial cable component, such as a male connector 500 (see FIGS. 4-6). However, those in the art should appreciate that the connector 700 may be formed without threads and designed to have a tolerance fit with another coaxial cable component, while the sensing circuit 730 is still able to sense mating forces. As shown, the spacer 770 operates with an internal surface of the connector body 750 to stabilize the center conductor contact 780 and help retain substantially axial alignment of the center conductor contact 780 with respect to the connector 700. The molded substrate 740 may be seated against an annular ridge 784 located on the center conductor contact 780. Seating the molded substrate 740 against the annular ridge 784 may help retain the spacer 740 in a substantially fixed position along the axis of connector 700 so that the molded substrate 740 does not axially slip or move due to interaction with the interface sleeve 760 when mating forces are applied. The molded substrate 740 is located on a spacer portion 782 of the center conductor contact 780 and has a close tolerance fit therewith to help prevent wobbling and/or misalignment of the center conductor contact 780.

Figure 4:
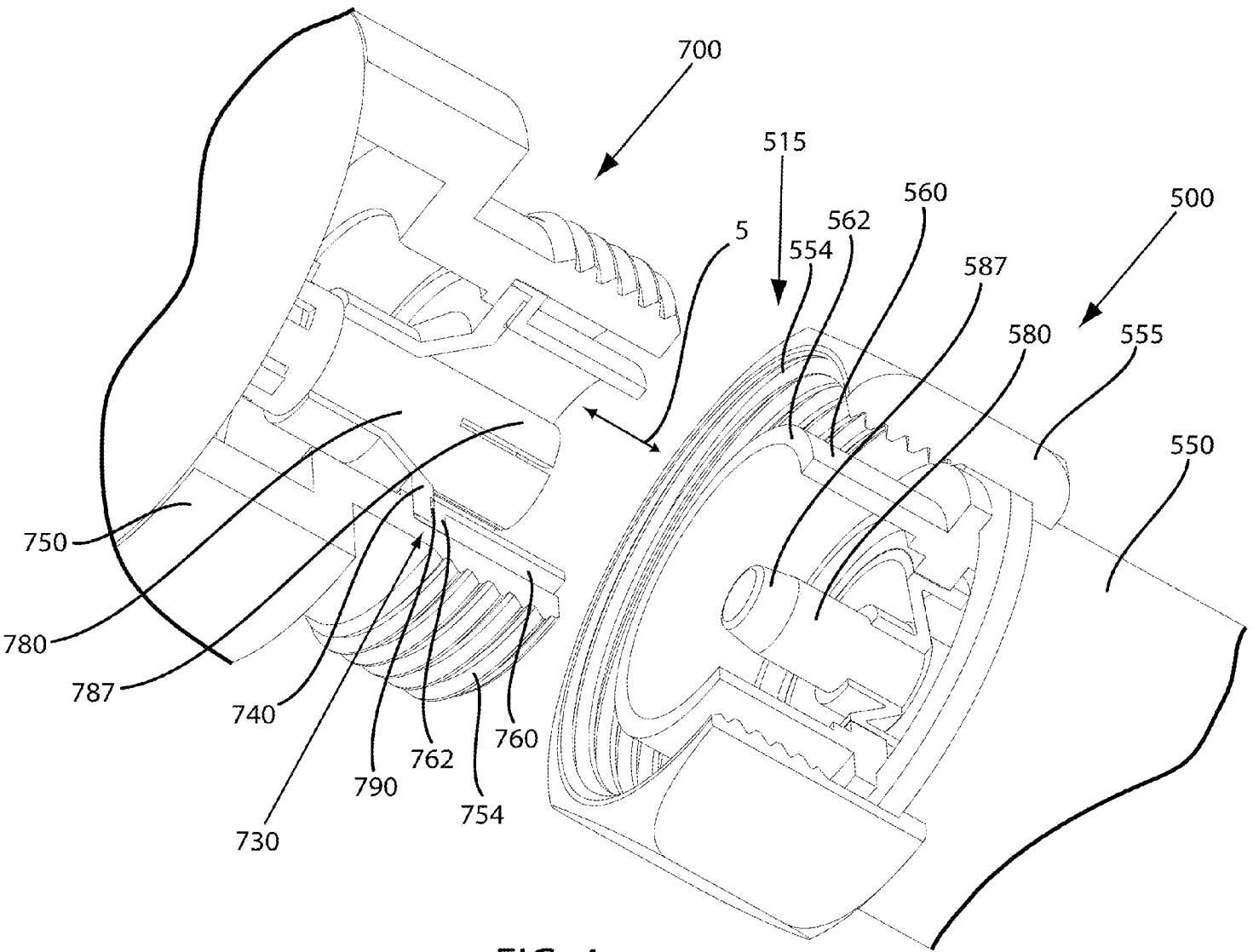
FIG. 4 depicts a cut-away perspective view of an embodiment of a coaxial cable connector just prior to mating with an embodiment of a male connector, in accordance with the present invention.
Figure 5:
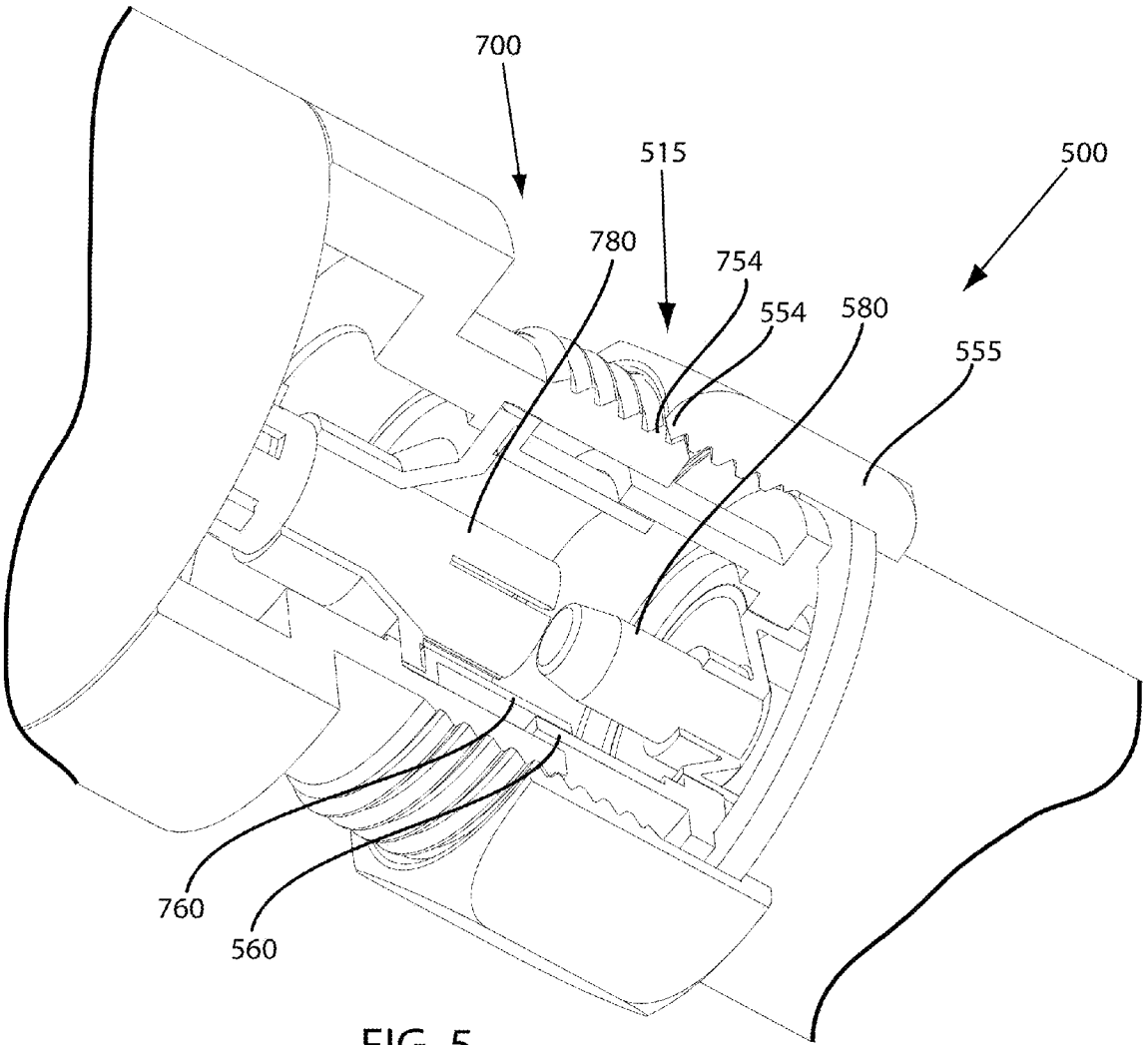
FIG. 5 depicts a cut-away perspective view of an embodiment of a cable connector during mating with an embodiment of a male connector, in accordance with the present invention.
Figure 6:
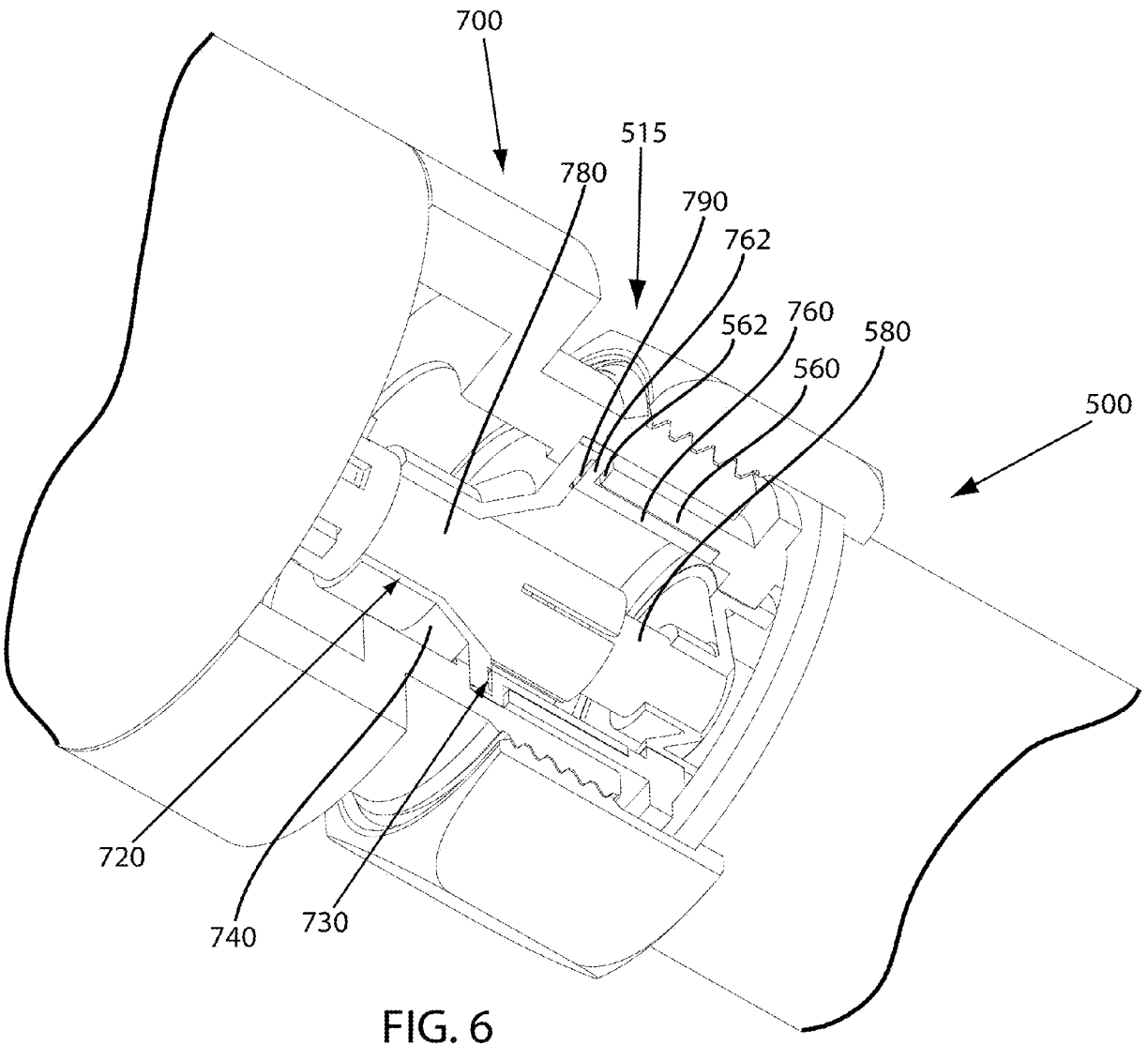
FIG. 6 depicts a cut-away perspective view of an embodiment of a mating force sensing coaxial cable connector mated with an embodiment of a male connector, in accordance with the present invention.

Mating of a connector 700 is described and shown with reference to FIGS. 4-6. A connector 700 can mate with RF ports of other components or coaxial cable communications devices, such as an RF port 515 of a male connector 500. The RF port 515 of the male connector 500 is brought into axial alignment with the mating force sensing connector 700. The two components are moved together or apart in a direction 5, as shown in FIG. 4. The male connector 500 may include a connector body 550 including an attached nut 555 having internal threads 554. The male connector 500 includes a conductive interface sleeve 560 having a leading edge 562. The interface sleeve 760 of the mating force sensing connector 700 may be dimensioned such that during mating the two interface sleeves 760 and 560 slidingly interact. The interface sleeve 760 may be designed to slidingly interact with the inner surface of the male connector 500 interface sleeve 560, as shown in FIG. 5. However, other embodiments of a connector 700 may include an interface sleeve 760 designed to slidingly interact with the outside surface of a connector component, such as interface sleeve 560. The sliding interaction of the interface sleeve 760 with the interface sleeve 560 may be snug, wherein the tolerance between the parts is close when the mating force sensing connector 700 is being mated to the male connector 500.

The female center conductor contact 780 of the force sensing connector 700 may include segmented portions 787. The segmented portions 787 may facilitate ease of insertion of a male center conductor contact 580 of the male connector 500. Additionally, the center conductor contact 580 of the male connector 500 may include a tapered surface 587 that further eases the insertion of the male center conductor contact 580 into the female center conductor contact 780. Those in the art should appreciate that a mating force sensing connector 700 may include a male center conductor contact 780 configured to mate with a female center conductor contact of another connector component.

FIG. 5 depicts an embodiment of a mating force sensing coaxial cable connector 700 during mating with an embodiment of an RF port 515 of a male connector 500. When the threaded nut 555 of the male connector 500 is initially threaded onto the threaded surface 754 of connector body 750, the interface sleeve 760 of the mating force sensing connector 700 may begin to slidingly advance against the inner surface of interface sleeve 560 of the male connector 500. The male center conductor contact 580 is axially aligned with the female center conductor contact 780 and readied for insertion therein.

When mated, the leading edge 562 of the interface sleeve 560 of the male connector 500 makes contact with the flexible member 762 of the interface sleeve 760 of the mating force sensing connector 700, as shown in FIG. 6. Contact between the leading edge 562 and the flexible member 762 facilitates transfer of force from the interface sleeve 560 to the interface sleeve 760. Mating force may be generated by the threading advancement of the nut 555 onto the threaded surface 754 of mating force sensing connector 700. However, mating force may be provided by other means, such as by a user gripping the connector body 550 of the male connector 500 and pushing it in a direction 5 (see FIG. 4) into mating condition with the force sensing connector 700. The force placed upon the flexible member 762 by the leading edge 562 may cause the flexible member 762 to bend.

Because the cavity or chamber 790 can be designed to have a known volume within a tight tolerance in an assembled mating force sensing connector 700, the sensing circuit 730 can be calibrated according to the known volume to sense corresponding changes in the volume. For example, if the male connector 500 is not threaded onto the mating force sensing connector 700 enough, then the leading edge 562 of the interface sleeve 560 does not place enough force against the flexible member 762 to bend the flexible member 762 sufficiently enough to create a change in the size of capacitive space 790 that corresponds to a sufficient and appropriate change in capacitance of the space 790. Hence, the sensing circuit 730, such as a capacitive circuit on the molded substrate 740, will not sense a change in capacitance sufficient to produce a signal corresponding to a proper mating force attributable to a correct mated condition. Or, if the male connector 500 is threaded too far and too tightly onto the mating force sensing connector 700, then the leading edge 562 of the interface sleeve 560 will place too much force against the flexible member 762 and will bend the flexible member 762 more than is sufficient to create a change in the size of capacitive space 790 that corresponds to a sufficient and appropriate change in capacitance of the space 790. Hence, the sensing circuit 730, such as a capacitive circuit on the first spacer insulator component 740, will sense too great a change in capacitance and will produce a signal corresponding to an improper mating force attributable to a too tightly-fitted mated condition.

Proper mating force may be determined when the sensing circuit 730 signals a correct change in electrical capacitance relative to the size of capacitive space 790. The correct change in size may correspond to a range of volume or distance, which in turn may correspond to a range of capacitance sensed by the sensing circuit 730. Hence, when the male connector 500 is advanced onto the mating force sensing connector 700 and the interface sleeve 560 exerts a force against the flexible member 762 of the interface sleeve 760, the force can be determined to be proper if it causes the flexible member to bend within a range that corresponds to the acceptable range of size change of capacitive space 790. The determination of the range acceptable capacitance change can be determined through testing and then associated with mating force conditions.

Once an appropriate capacitance range is determined, then calibration may be attributable to a multitude of mating force sensing connectors 700 having substantially the same configuration. The size and material make-up of the various components of the multiple connectors 700 can be substantially similar. For example, a multitude of mating force connectors 700 may be fabricated and assembled to have a regularly defined capacitive space 790 in immediate proximity with a bendable wall or boundary surface, such as flexible member 762, wherein the capacitive space 790 of each of the multiple connectors 700 is substantially the same size. Furthermore, the multiple connectors 700 may include a sensing circuit 730, such as a capacitive circuit, printed on a molded substrate 740, the molded substrate 740 being an insulator component. The sensing circuit 730 on each of the molded substrates 740 of the multiple connectors 700 may be substantially similar in electrical layout and function. For instance, the sensing circuit 730 for each of the multiple connectors 700 may sense capacitance substantially similarly. Then, for each of the multitude of connectors 700, capacitance may predictably change relative to size changes of the capacitive space 790, attributable to bending of the flexible member 762 corresponding to predictable mating force. Hence, when capacitance falls within a particular range, as sensed by sensing circuit 730, then mating force can be determined to be proper for each of the multiple connectors 700 having substantially the same design, component make-up, and assembled configuration. Accordingly, each connector 700 of the multiple mating force connectors 700 having substantially the same design, component make-up, and assembled configuration does not need to be individually calibrated. Calibration can be done for an entire similar product line of connectors 700. Then periodic testing can assure that the calibration is still accurate for the line. Moreover, because the sensing circuit 730 is integrated into existing connector components, the mating force sensing connector 700 can be assembled in substantially the same way as typical connectors and requires very little, if any, mass assembly modifications.

Figure 7:
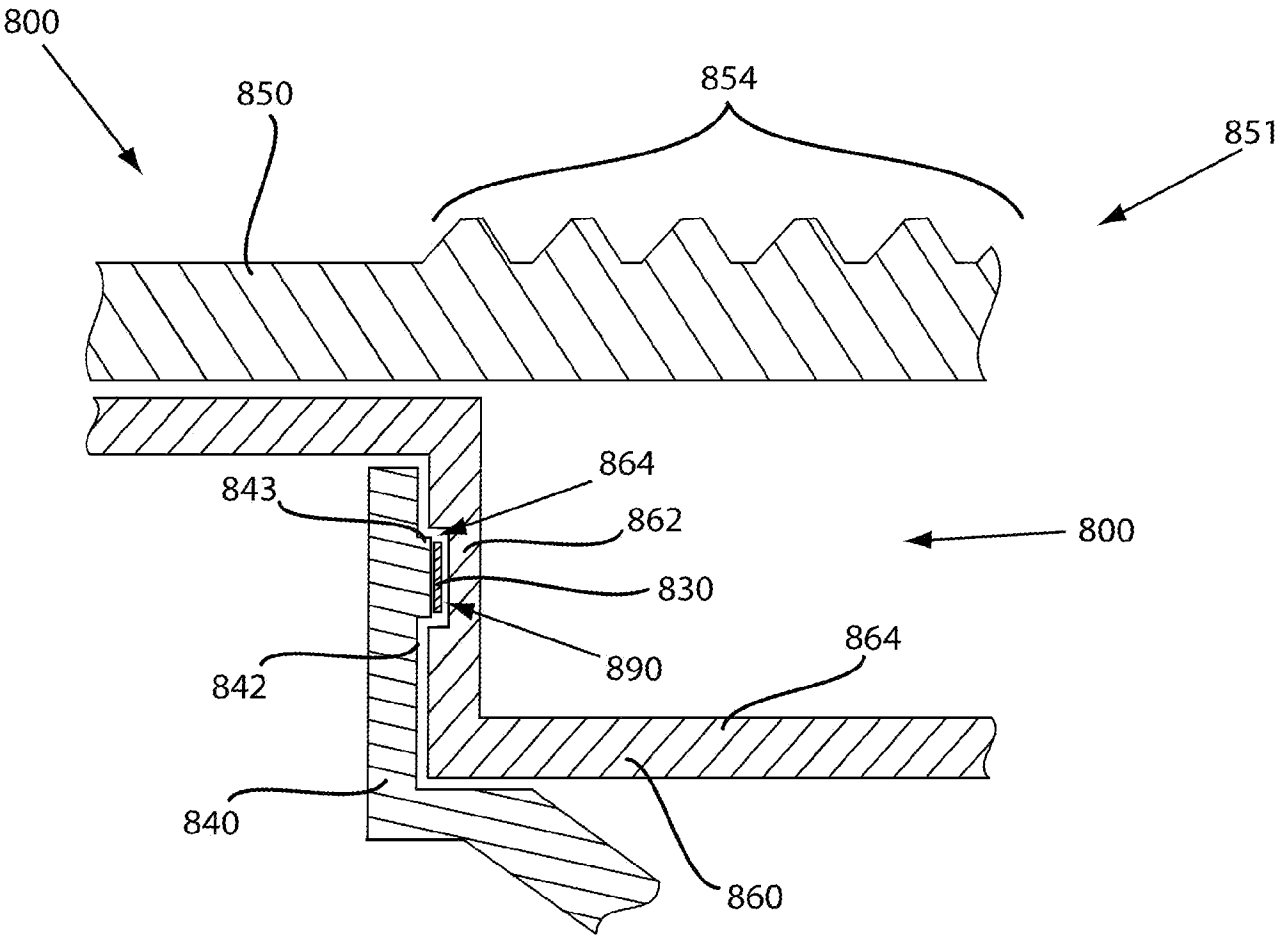
FIG. 7 depicts a partial cross-sectional view of a further embodiment of a coaxial cable connector with integrated force mating force sensing circuit, in accordance with the present invention.

With further reference to the drawings, FIG. 7 depicts a partial cross-sectional view of a further embodiment of a coaxial cable connector 800 with integrated force mating force sensing circuit 830. The mating force sensing circuit 830 may be a capacitive circuit positioned on a mount portion 843 of a first face 842 of an embodiment of a molded substrate 840. The capacitive circuit 830 may be printed on the mount portion 843. The mount portion 843 may protrude somewhat from the first face 842 of the molded substrate 840 to help position the capacitive circuit 830 in immediate proximity with a first section bore 863 of a first section 862 of an interface member 860 to define a capacitive space 890 located between the face 842 and the molded substrate 840. The interface member 860 also includes a second section 864. The first section 862 of the interface member 860 may be flexible so that it can move between a first non-bent position and a second bent position upon the application of an axial force by a mating component 860 on the first section 862. When in a second bent position, the first section 862 of the interface member 860 may move closer to the first surface 842 of the molded substrate 840 thereby decreasing the volume of the capacitive space 890 existent proximate the capacitive circuit 830 on the mount portion 843 immediately proximate the first section bore 863 of the first section 862. The capacitive circuit 830 can detect the decrease in size of the capacitive space 890 and correlate the change in size with mating force exerted on the interface member 860.

The connector 800 embodiment may include a connector body 850 having a threaded portion 854 located proximate a first end of the connector body 850. The first end 751 of the connector 800 may axially oppose a second end 852 of the connector 800 (not shown, but similar to second end 752 of connector 700 depicted in FIG. 1). In addition, the connector body 850 may include a first bore 856 extending axially from the first end 851. The first bore 856 may be large enough to accommodate the first spacing insulator 840 and the interface member 860 so that the connector body 850 may house the molded substrate 840 and the interface member 860. Moreover, the first end 851, including the first bore 851, may be sized to mate with another coaxial cable component, such as male connector 500 depicted in FIGS. 4-6.

An embodiment of a method for detecting an RF signal (or harvesting power) or a mating force of a mated coaxial cable connector 700, 800 is described with reference to FIGS. 1-7. One step of the mating force detecting method includes providing a coaxial cable connector, such as connector 700 or 800. The connector 700, 800 may include a sensing circuit 730, 830, coupler 720, conductive interconnects or traces 731, electrical components 562, and/or an integrated circuit 504 positioned on a face 742, 842 of a spacer component 740, 840 located within a connector body 750, 850. In addition, the connector 700, 800 may include a capacitive space 790, 890 in immediate proximity with the sensing circuit 730, 830. Moreover, the connector 700, 800 may have an interface component 760, 860 having a flexible member 762, 862 forming at least one surface or boundary portion of the capacitive space 790, 890. The flexible member 762, 862 may be movable due to mating forces.

Another step of the coaxial cable connector mating force detection method includes mating the connector 700, 800 with a connecting device, such as the male connector 500, or any other structurally and functionally compatible coaxial cable communications component. Yet another mating force detection step includes bending the flexible member 762, 862 of the interface component 760, 860 due to contact with the connecting device, such as male connector 500, during mating, thereby reducing the size of the capacitive space 790, 890. Still further, the mating force detection methodology includes detecting mating force by sensing the reduction of capacitive space 790, 890 size by the sensing circuit 730, 830. The size change of the space 790, 890 may then be correlated with the mating force exerted on the interface member 760, 860.

Figure 8B:
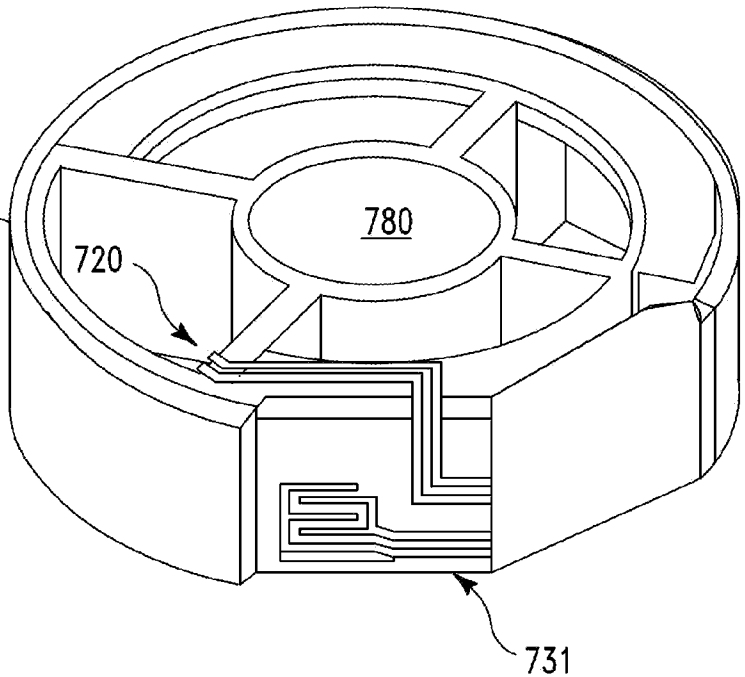
FIGS. 8A and 8B depict perspective views of an embodiment of the molded substrate of FIG. 1, in accordance with the present invention.
Figure 8A:
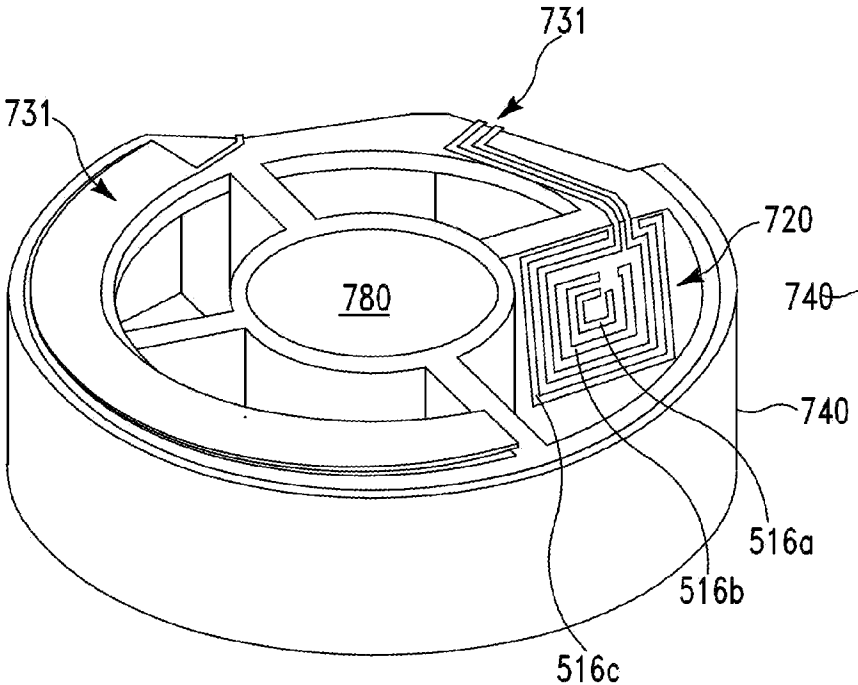

FIGS. 8A and 8B depict perspective views of an embodiment of the molded substrate 740 comprising the coupler 720, integrated circuit 504, electrical components 562, and conductive interconnects or traces 731 of FIG. 1. FIGS. 8A and 8B illustrate the coupler 720 mounted to or integrated with the molded substrate 740. Coupler 720 illustrated in FIG. 8A comprises a loop coupler that includes optional loops 516*a*, 516*b*, and 516*c* for impedance matching, etc. The molded substrate 740 may comprise a molded interconnect device (e.g., a disk) generated using a laser direct structuring process on syndiotactic polystyrene material with an LDS additive and plated with an electro-less plating process. The molded substrate 740 is designed to be inserted into a coaxial cable connector housing and provide an electronic sensing and processing platform (i.e., for the sensor 730, coupler 720, integrated circuit 504, electrical components 562, conductive interconnects or traces 731). The molded substrate 740 may be generated using materials and processes including, among other things, a syndiotactic polystyrene with LDS additive, a liquid crystal polymer with additive, an injection molding process, a laser activation process, an electro-less plating process, etc. The molded substrate 740 may include multiple sensors defined on its surface to determine a state of a coaxial cable connector and provide information on a status of the connector and quality of an RF signal. The molded substrate 740 comprises a dielectric material capable of being mechanically inserted into a coaxial cable connector housing without deformation. The molded substrate 740 acts a platform for mounting sensors used to monitor parameters that measure a viability of RF coaxial cable connectors (e.g., mating tightness, moisture, temperature, impedance, etc.). Additionally, the molded substrate 740 provides a surface for placing micro-antenna structures (e.g., coupler 720) used to couple energy from the coaxial cable, measure both the forward and reverse propagating RF voltage signals on a coaxial cable, and provide a coupling connection to the cable for transmitting and receiving data to and from all components on or within the molded substrate 740. The molded substrate 740 may be included in passive transponder system intended to monitor information being sent and received through a transmission line, extract energy from near field RF sources, and sense a state of a remote station over a transmission line such as a coaxial cable. The molded substrate 740 allows for real time sensing of an RF connector and coaxial cable system reliability.

Figure 8C:
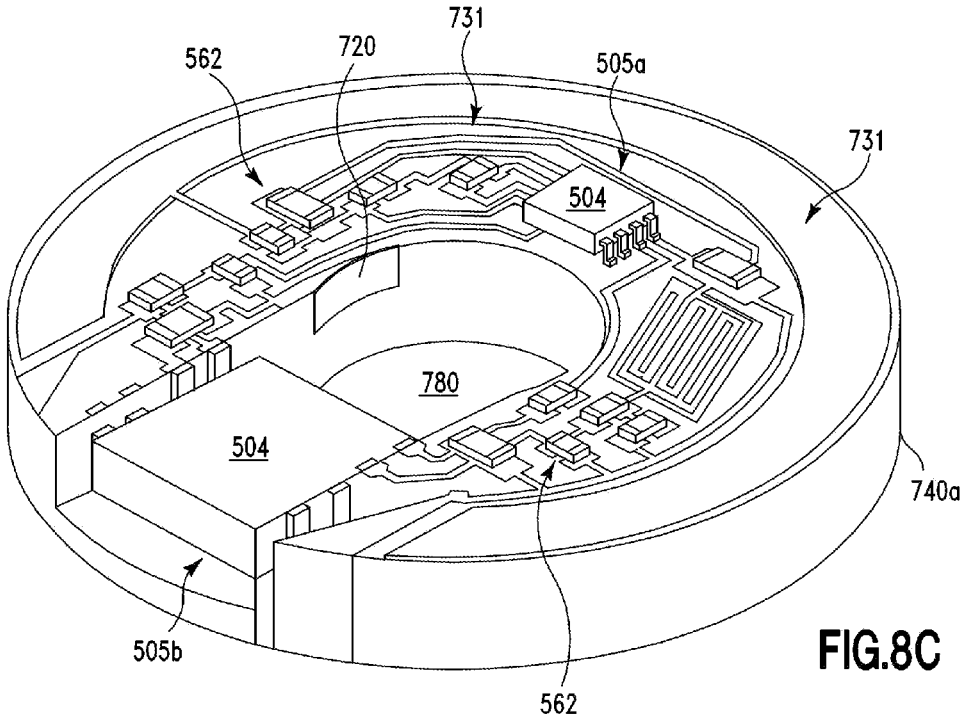
FIG. 8C depicts a perspective view of an alternative embodiment of a molded substrate 740, in accordance with the present invention.

FIG. 8C depicts a perspective view of an embodiment of a molded substrate 740*a* (i.e., an alternative geometry to the geometry of molded substrate 740) comprising a top mounted and/or recessed integrated circuit 504, electrical components 562, and conductive interconnects or traces 731. The integrated circuit 504 of FIG. 8C includes two different versions (either version may be used) of the integrated circuit 504: a top mounted version 505*a* and a recessed mounted version 505*b*. Alternatively, a combination of the top mounted version 505*a* and the recessed mounted version 505*b* of the integrated circuit 504 may be used in accordance with embodiments of the present invention. Additionally, the molded substrate 740*a* may comprise additional electrical components 562 (e.g., transistors, resistors, capacitors, inductors, etc)

Figure 8D:
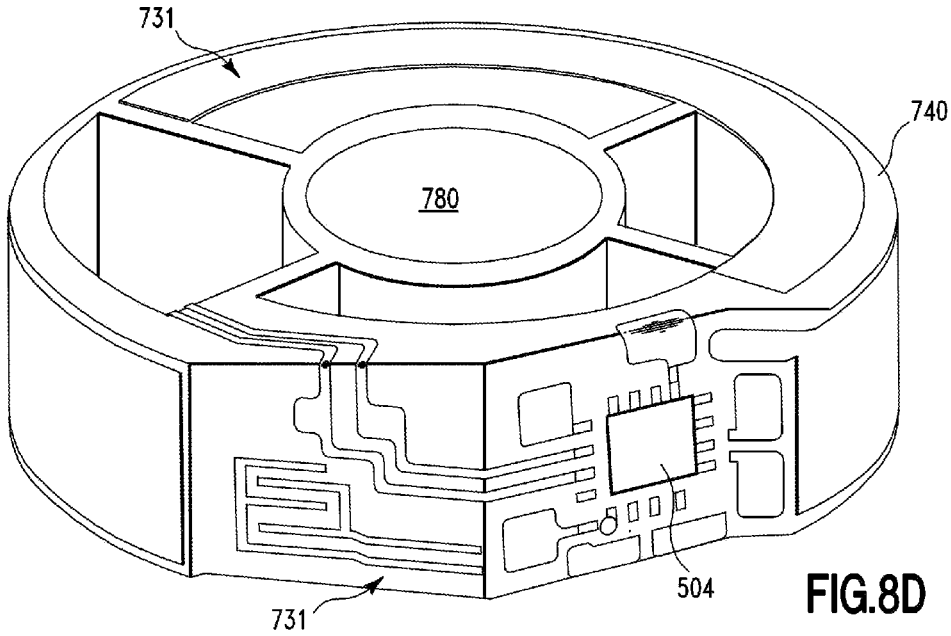
FIG. 8D depicts a perspective view of an embodiment of a molded substrate comprising an integrated circuit 504, in accordance with the present invention.

FIG. 8D depicts a perspective view of an embodiment of the molded substrate 740 comprising the integrated circuit 504 mounted to or integrated with a side portion of the molded substrate 740.

Figure 8E:
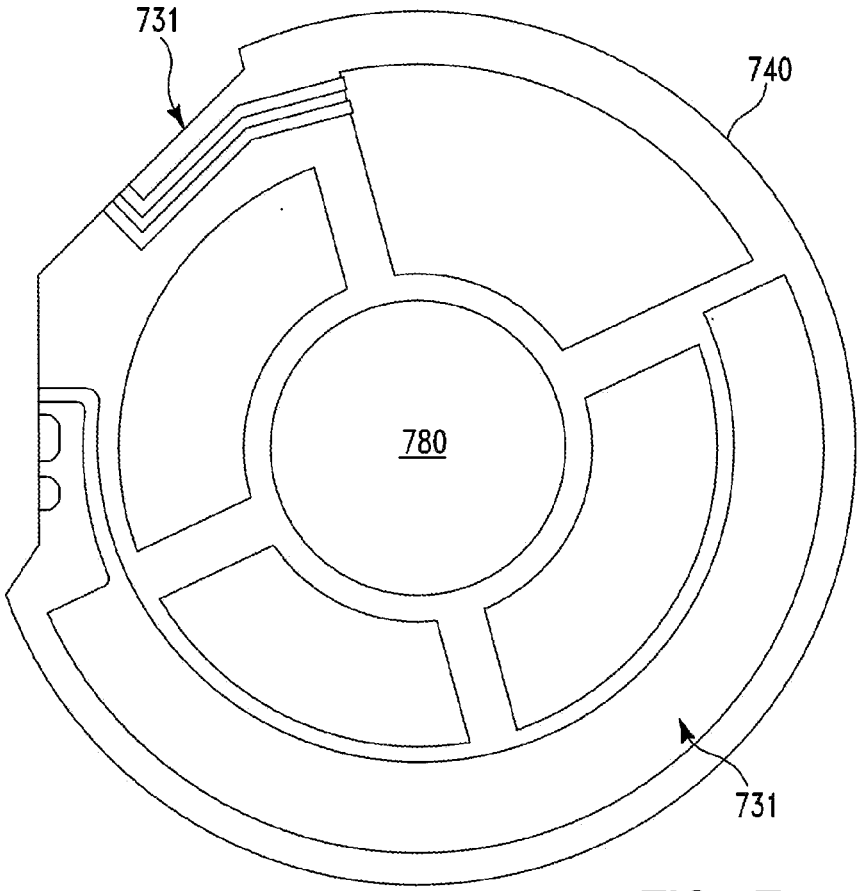
FIG. 8E depicts a top view of an embodiment of a molded substrate, in accordance with the present invention.

FIG. 8E depicts a top view of an embodiment of the molded substrate 740 comprising various conductive interconnects or traces 731 (e.g., comprising a metallic material) mounted to or integrated with a top side of the molded substrate 740.

Figure 8F:
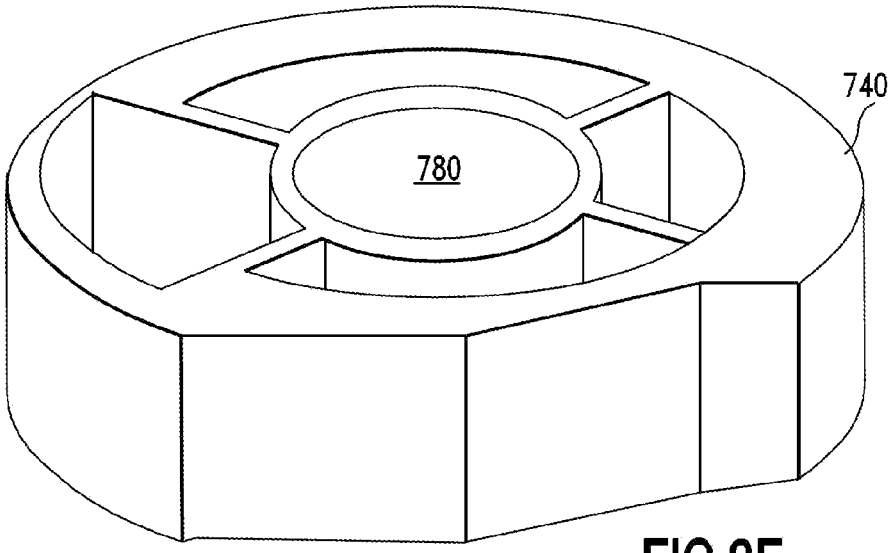
FIG. 8F depicts a perspective view of an embodiment of a molded substrate 740 without any components, in accordance with the present invention.

FIG. 8F depicts a perspective view of an embodiment of the molded substrate 740 without any components.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A substrate structure comprising:

a molded substrate located between a center conductor contact and an outer conductor contact within a connector body of a coaxial cable connector; and an electrical structure mechanically connected to the molded substrate, wherein the electrical structure is located in a position that is external to a signal path of a radio frequency (RF) signal flowing through the center conductor contact of the coaxial cable connector, wherein the electrical structure comprises a metallic coupler circuit configured to wirelessly sense the RF signal flowing through the center conductor contact of the coaxial cable connector, wherein the metallic coupler circuit is external to and mechanically isolated from the center conductor contact within the coaxial cable connector, and wherein the metallic coupler circuit is located between the center conductor contact and the outer conductor contact.

2. The substrate structure of claim 1, further comprising a signal processing circuit mechanically attached to the molded substrate, wherein metallic coupler circuit is configured to extract samples of the RF signal flowing through the coaxial cable connector, and wherein the signal processing circuit is configured to report the samples of said RF signal to a location external to the coaxial cable connector.

3. The substrate structure of claim 1, wherein metallic coupler circuit is configured to extract an energy signal from the RF signal flowing through the coaxial cable connector, and wherein the energy signal is configured to apply power to an electrical device located within the coaxial cable connector.

4. The substrate structure of claim 3, wherein the electrical device is mechanically attached to the molded substrate.

5. The substrate structure of claim 1, wherein the metallic coupler circuit is formed within a surface of the molded substrate structure.

6. The substrate structure of claim 1, wherein the electrical structure comprises metallic traces for connections between electrical components mechanically attached to the molded substrate.

7. The substrate structure of claim 1, wherein the molded substrate comprises a disk structure.

8. The substrate structure of claim 7, wherein the molded substrate is positioned to axially align center conductor contact within the connector body.

9. The substrate structure of claim 1, wherein the molded substrate comprises a material selected from the group consisting of syndiotactic polystyrene and a liquid crystal polymer.

10. A coaxial cable connector for connection to a coaxial cable, the connector comprising:

a connector body; and a molded substrate structure located between a center conductor contact and an outer conductor contact within the connector body, wherein the molded substrate structure comprises an electrical structure mechanically connected to the molded substrate structure, wherein the electrical structure is located in a position that is external to a signal path of a radio frequency (RF) signal flowing through the center conductor contact of the coaxial cable connector, wherein the electrical structure comprises a metallic coupler circuit configured to wirelessly sense the RF signal flowing through the center conductor contact of the coaxial cable connector, wherein the metallic coupler circuit is external to and mechanically isolated from the center conductor contact within the coaxial cable connector, and wherein the metallic coupler circuit is located between the center conductor contact and the outer conductor contact.

11. The coaxial cable connector of claim 10, wherein the center conductor contact is electrically and mechanically connected to a center conductor of the coaxial cable.

12. The coaxial cable connector of claim 11, wherein the molded substrate structure is positioned to axially align the center conductor contact within the connector body.

13. The coaxial cable connector of claim 11, wherein the molded substrate structure includes traces positioned at a location to make electrical contact between the center conductor contact and the electrical structure when the connector is assembled.

14. The coaxial cable connector of claim 10, wherein the metallic coupler circuit is configured to extract samples of the RF signal flowing through the coaxial cable connector.

15. The coaxial cable connector of claim 10, wherein the metallic coupler circuit is configured to extract an energy signal from the RF signal flowing through the coaxial cable connector, and wherein the energy signal is configured to apply power to an electrical device located within the coaxial cable connector.

16. The coaxial cable connector of claim 10, wherein the metallic coupler circuit is formed within a surface of the molded substrate structure.

17. The coaxial cable connector of claim 10, wherein the electrical structure comprises metallic traces for connections between electrical components mechanically attached to the molded substrate structure.

18. A method comprising:

providing substrate structure comprising a molded substrate located between a center conductor contact and an outer conductor contact within a connector body of a coaxial cable connector and an electrical structure mechanically connected to the molded substrate, wherein the electrical structure comprises a metallic coupler circuit, wherein the electrical structure is located in a position that is external to a signal path of a radio frequency (RF) signal flowing through the coaxial cable connector, wherein the metallic coupler circuit is external to and mechanically isolated from the center conductor contact within the coaxial cable connector, and wherein the metallic coupler circuit is located between the center conductor contact and the outer conductor contact; and wirelessly sensing, by the electrical structure, the RF signal flowing through the center conductor contact of the coaxial cable connector.

19. The method of claim 18, wherein the substrate structure further comprises a signal processing circuit mechanically attached to the molded substrate and electrically connected to the electrical structure, and wherein the method further comprises:

extracting, by the electrical structure, samples of the RF signal flowing through the coaxial cable connector; and reporting, by the signal processing circuit, the samples of the RF signal to a location external to the coaxial cable connector.

20. The method of claim 18, further comprising:

extracting, by the electrical structure, an energy signal from the RF signal flowing through the coaxial cable connector; and applying, by the energy signal, apply power to an electrical device located within the coaxial cable connector.

21. The method of claim 18, further comprising:

axially aligning, by the molded substrate, a center conductor contact within the connector body.

22. The method of claim 18, further comprising:

forming the substrate structure by a process selected from the group consisting of an injection molding process, a laser activation process, and an electro-less plating process.

* * * * *